United States Patent [19]

Sato et al.

[11] Patent Number: 4,626,500

[45] Date of Patent: Dec. 2, 1986

[54] HEAT-DEVELOPABLE PHOTOGRAPHIC LIGHT-SENSITIVE MATERIAL

[75] Inventors: Kozo Sato; Hiroshi Kitaguchi; Hiroyuki Hirai, all of Kanagawa, Japan

[73] Assignee: Fuji Photo Film Co., Ltd., Kanagawa, Japan

[21] Appl. No.: 776,177

[22] Filed: Sep. 13, 1985

[30] Foreign Application Priority Data

Sep. 14, 1984 [JP] Japan ..... 59-193467

[51] Int. Cl.[4] ..... G03C 1/06; G03C 1/40; G03C 5/54

[52] U.S. Cl. ..... 430/617; 430/203; 430/218; 430/619; 430/955

[58] Field of Search ..... 430/203, 218, 351, 353, 430/617, 619, 620, 955

[56] References Cited

U.S. PATENT DOCUMENTS 4,288,536 9/1981 Goettert et al. ..... 430/617

4,550,071 10/1985 Aono et al. ..... 430/617

*Primary Examiner*—Richard L. Schilling

*Attorney, Agent, or Firm*—Sughrue, Mion, Zinn, Macpeak & Seas

[57] ABSTRACT

A heat-developable photographic light-sensitive material is described, comprising a support having thereon, at least one layer containing a compound represented by the general formula (I) or (II) below:

(I)

(II)

wherein R and R′ each represents a group selected from a hydrogen atom, an alkyl group, a cycloalkyl group, an alkenyl group, an alkynyl group, an aralkyl group, an aryl group, an amino group, an acylamino group, an alkoxy group, an alkylthio group, a sulfonylamino group, a heterocyclic ring group and a substituted group of them; X represents atoms forming a 5-membered or 6-membered ring; A represents a group causing a decarboxylation reaction.

This heat-developable photographic light-sensitive material provides a high maximum density and low fog by heat-developing at a relatively low temperature and for a short time.

13 Claims, No Drawings

HEAT-DEVELOPABLE PHOTOGRAPHIC LIGHT-SENSITIVE MATERIAL

FIELD OF THE INVENTION

The present invention relates to a silver halide photographic light-sensitive material, and more particularly to a heat-developable photographic light-sensitive material forming color images upon heat development.

BACKGROUND OF THE INVENTION

Heat-developable photographic light-sensitive materials and a process for forming images using the materials are well known and are described in detail, for example, in *Shashin Kogaku no Kiso* (Fundamentals of Photographic Engineering), Corona Co., Ltd., Tokyo, pp. 553–555 (1979), *Eizo Joho* (Image Information) (April, 1978), pp. 40, and *Neblett's Handbook of Photography and Reprography,* 7th Ed., Van Nostrand Reinhold Company, pp. 32–33 (1977). For the formation of, in particular, color images, various techniques have been proposed, including a method in which couplers are used as dye releasing compounds (see U.S. Pat. Nos. 3,531,286, 3,761,270, 4,021,240, Belgian Pat. No. 802,519, and *Research Disclosure* (September, 1975), pp. 31–32), a method in which compounds with a nitrogen-containing heterocyclic ring group introduced in the dye portion are used as dye releasing compounds (see *Research Disclosure* (May, 1978), pp 54–58), a method utilizing the silver dye bleaching process (see *Research Disclosure* (April, 1976), pp. 30–32, ibid. (December, 1976), pp. 14–15, and U.S. Pat No. 4,235,957), and a method utilizing leuco dyes (see U.S. Pat. Nos. 3,985,565 and 4,022,617).

These methods, however, have their respective disadvantages. Their common disadvantages are that the development requires relatively long periods of time, images formed have undesirably high fog levels, and on the contrary, the maximum density ($D_{max}$) is lower than desired.

In order to overcome the above problems, Japanese Patent Application (OPI) No. 58,543/83 (The term "OPI" as used herein refers to a "published unexamined Japanese patent application".) discloses a method using dye releasing reductive compounds which release hydrophilic dyes. Although this method has succeeded in ameliorating the above disadvantages, it has been desired to obtain a light-sensitive material which can be heat-developed at relatively low temperatures, and in short period of time, and in which a high maximum density can be obtained while preventing the formation of fog.

As a result of extensive studies, the present inventors have found that the properties of the light-sensitive material of the prior art are extraordinarily improved when the specific compounds which accelerate development of the light-sensitive material without lowering storage ability.

SUMMARY OF THE INVENTION

An object of the present invention is to provide a heat-developable color photographic light-sensitive material in which a high maximum density can be obtained while substantially preventing the formation of fog, by heat development at relatively low heating temperatures and for short periods of time.

The above object of the present invention is attained by a heat-developable light-sensitive material comprising a support having theron at least one layer containing at least a compound represented by formula (I) or (II)

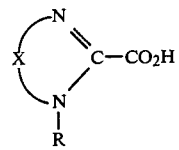

(I)

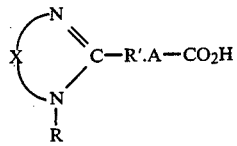

(II)

wherein R and R′ each represents a group selected from a hydrogen atom, an alkyl group, a cycloalkyl group, an alkenyl group, an alkynyl group, an aralkyl group, an aryl group, an amino group, an acylamino group, a sulfonylamino group, an alkoxy group, an alkylthio group, a heterocyclic ring group or a substituted group of them; X represents atoms forming a 5-membered or 6-membered ring. A represents a group causing a decarboxylation reaction.

Preferred examples of R and R′ include a hydrogen atom, a substituted or unsubstituted alkyl group having from 1 to 8 carbon atoms, a substituted or unsubstituted aralkyl group having from 7 to 14 carbon atoms, a substituted or unsubstituted amino group, an alkoxy group having from 1 to 4 carbon atoms, an alkylthio group having from 1 to 4 carbon atoms, etc. Particularly preferred examples include a hydrogen atom, a substituted or unsubstituted lower alkyl group having from 1 to 3 carbon atoms (for example, a methyl group, an ethyl group, a hydroxyethyl group, a methoxyethyl group, a cyanoethyl group, etc.), a substituted or unsubstituted amino group (for example, an amino group, a methylamino group, a dimethylamino group, a piperidino group, a morpholino group, etc.), an alkoxy group having from 1 to 3 carbon atoms (for example, a methoxy group, an ethoxy group, a methoxyethoxy group, etc.) and an alkylthio (for example, a methylthio group, an ethylthio group, a hydroxyethylthio group, etc.).

X represents atoms forming a 5-membered or 6-membered ring. This ring may be saturated or unsaturated. X may comprise only carbon atoms or may contain a hetero atom. The most preferred rings are an imidazole ring, a benzimidazole ring, an imidazoline ring, and a tetrahydropyrimidine ring.

A represents a group causing a decarboxylation reaction. Preferred examples are described in Japanese Patent Application (OPI) No. 195237/84. Particularly preferred examples of an A—$CO_2H$ compound include trichloroacetic acid compounds, α-sulfonylacetic acid compounds, propiolic acid compounds, etc. A structural feature of the above compounds of the present invention (hereinafter referred to as the compound of the present invention) is to have a carboxyl group which is easy to decarboxylate by heating. The compound of the present invention releases a basic N-containing heterocyclic compound. It is described in Japanese Patent Application (OPI)No. 177550/84 that this realeased N-containing heterocyclic compound accelerates development.

However, when this N-containing heterocyclic compound is added directly into a light-sensitive material, the storage stability thereof over a period of time is remarkably lowered. The compound of the present invention overcomes the defect. Because the compound of the present invention releases the N-containing heterocyclic compound on heat-development, the storage stability is not impaired at all.

The amount of compound of the present invention used can be varied over a wide range. An effective range is not more than 50% by weight, based on the total weight of the layer (by weight) of the light-sensitive material in which it is incorporated, and a preferable range is from 0.01% to 40% by weight.

Preferred examples of the compounds of the present invention are described in the following.

(1)

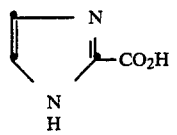

(2)

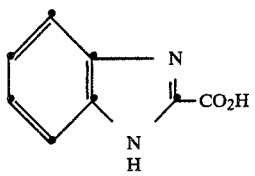

(3)

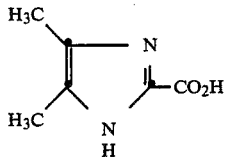

(4)

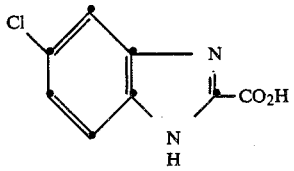

(5)

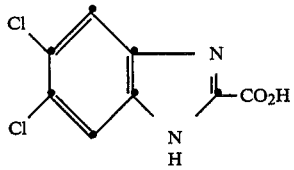

(6)

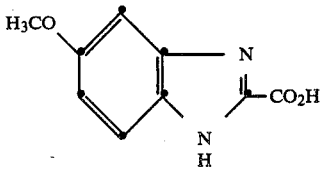

(7)

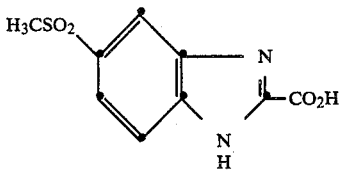

-continued (8)

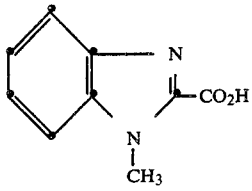

(9)

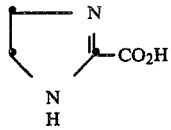

(10)

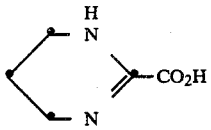

(11)

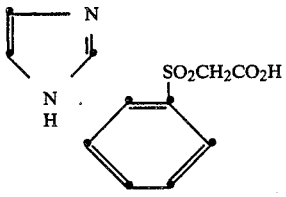

(12)

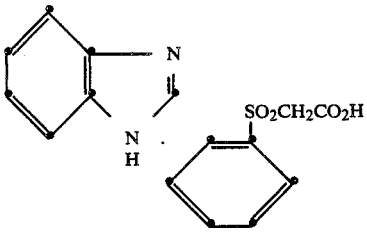

(13)

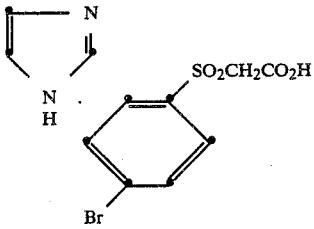

(14)

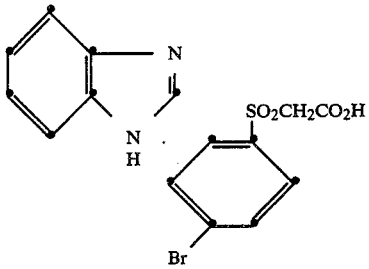

(15)

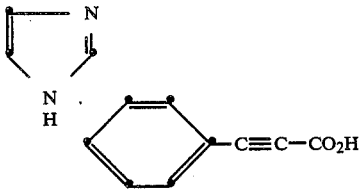

-continued
(16)
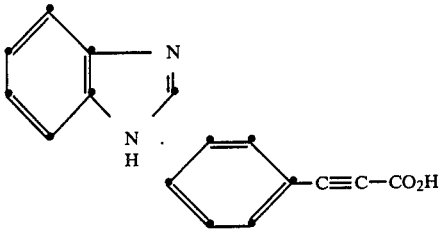
(17)
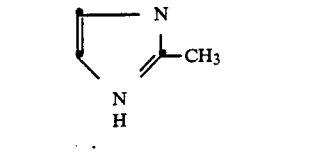
(18)
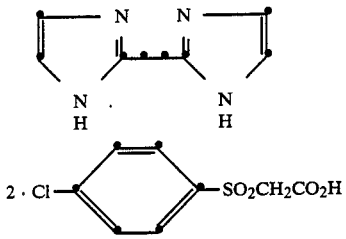
(19)
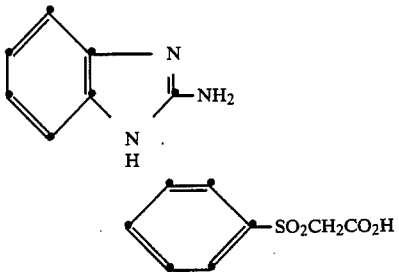
(20)
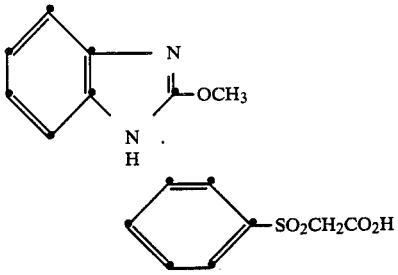
(21)
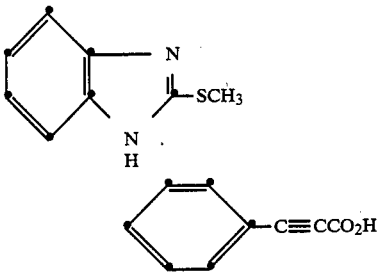
-continued
(22)
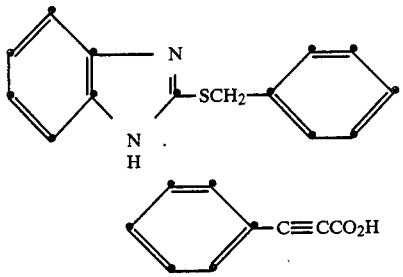
(23)
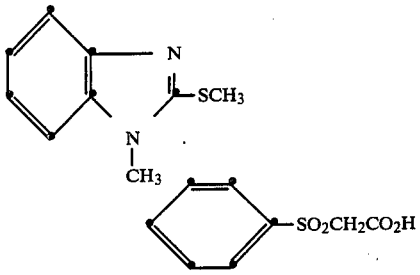
(24)
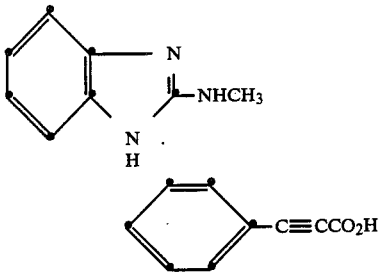
(25)
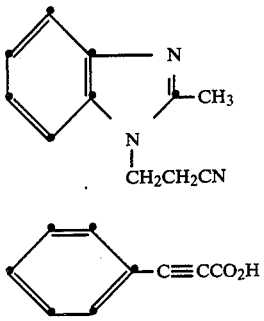
(26)
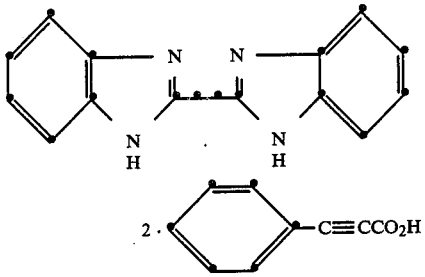
Methods of synthesizing compounds of the present invention are illustrated by the following specific examples.

SYNTHESIS EXAMPLE 1

Synthesis of Compound (2):

A mixture of 23 g of o-phenylenediamine and 23 g of glycollic acid was heated at 120° C. for 2.5 hours. After cooling, 200 ml of water was added to the mixture and the mixture was adjusted to a pH of 8 by an aqueous solution of sodium hydroxide. The mixture was stirred while cooling with ice for one hour, and crystals were filtered out and washed with cool water.

Crude crystals were recrystallized from water to obtain 18 g of 2-hydroxymethylbenzimidazole having a melting point of 157° C.

An aqueous solution of 18.8 g of potassium permanganate dissolved in 100 ml of water was added little by little into a mixture of 12 g of 2-hydroxymethylbenzimidazole, 80 ml of water and 5 ml of a 10% aqueous solution of sodium carbonate which is heated at 80° C. After an addition, the mixture was heated at 80° to 85° C. for half an hour. While hot, the mixture was filtered by use of Celite (trademark for diatomaceous earth). The used Celite was further washed with hot water. The filtered solution was adjusted to a pH of 4 by additon of acetic acid, and cooled to 0° C. with ice. The crystals obtained were filtered out. The crude crystals were recrystallized from a mixed solvent of water and methanol to obtain 5.8 g of white crystals of compound (2) having a melting point of 169° C. (decomposition).

SYNTHESIS EXAMPLE 2

Synthes s of Compound (14):

A mixture of 27.9 g of p-bromophenylsulfonylacetic acid, 11.8 g of benzimidazole and 100 ml of methanol was stirred at room temperature for one hour. Methanol was distilled off from the mixture at below 50° C. under reduced pressue. The colorless sticky liquid obtained was left to crystallize slowly. Then the crystals were ground and washed with n-hexane to obtain 39.6 g of Compound (14), having a melting point of 109° to 111° C. (decomposition).

According to the present invention, silver can be utilized as an image forming substance. Further, various other image forming substances can be employed in various image forming processes.

For instance, couplers capable of forming color images upon reaction with an oxidation product of a developing agent which are used in liquid development processing widely known hitherto can be employed. For examle, as magenta couplers, there are 5-pyrazolone couplers, pyrazolobenzimidazole couplers, cyanoacetylcoumarone couplers and open chain acylacetonitrile couplers, etc. As yellow couplers, there are acylacetamide couplers (for example, benzoylacetanilides and pivaloylacetanilides), etc. As cyan couplers, there are naphthol couplers and phenol couplers, etc. It is preferred that these couplers be nondiffusible substances which have a hydrophobic group called a ballast group in the molecule thereof or be polymerized substances. The couplers may be any of the 4-equivalent type and 2-equivalent type to silver ions. Further, they may be colored couplers having a color correction effect or couplers which release a development inhibitor at development processing (so-called DIR couplers).

Further, dyes for forming positive color images by a light-sensitive silver dye bleach processes, for example, those as described in *Research Disclosure,* No. 14433, pages 30–32 (April, 1976), ibid., No. 15227, pages 14–15 (December, 1976) and U.S. Pat. No. 4,235,957, etc., can be employed.

Moreover, leuco dyes as described, for example, in U.S. Pat. Nos. 3,985,565 and 4,022,617, etc., can be used.

Further, dyes to which a nitrogen-containing heterocyclic group have been introduced as described in *Research Disclosure,* No. 16966, pages 54–58 (May, 1978), may be employed.

In addition, dye providing substances which release a mobile dye by utilizing a coupling reaction of a reducing agent oxidized by an oxidation reduction reaction with a silver halide or an organic silver salt at high temperature as described in European Pat. No. 79,056, West German Pat. No. 3,217,853, European Pat. No. 67,455, etc., and dye providing substances which release a mobile dye as a result of an oxidation reduction reaction with a silver halide or an organic silver salt at high temperature as described in European Pat. No. 76,492A, West German Pat. No. 3,215,485, European Pat. No. 66,282, Japanese Patent Application Nos. 28928/83 and 26008/83, etc., can be employed.

Preferred dye providing substances which can be employed in these processes can be represented by the following general formula (CI):

$$(\text{Dye}—X)_q—Y \qquad \text{(CI)}$$

wherein Dye represents a dye which becomes mobile when it is released from the molecule of the compound represented by the general formula (CI); X represents a simple bond or a connecting group; Y represents a group which releases Dye in correspondence or counter-correspondence to light-sensitive silver salts having a latent image distributed imagewise, the diffusibility of Dye released being different from that of the compound represented by formula (CI) and q represents an integer of 1 or 2.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form of having temporarily shorter wavelengths, the color of which is recoverable in the development processing.

More specifically, the dyes as described in European Pat. No. 76,492A can be utilized.

Examples of the connecting group represented by X include —NR— (wherein R represents a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (CI) are described in greater detail.

In one embodiment, Y is selected so that the compound represented by the general formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

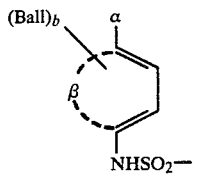

(CII)

wherein $\beta$ represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like;

$\alpha$ represents a group of $—OG^{11}$ or $—NHG^{12}$ (wherein $G^{11}$ represents hydrogen or a group which forms a hydroxyl group upon being hydrolyzed, and $G^{12}$ represents hydrogen, an alkyl group containing 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

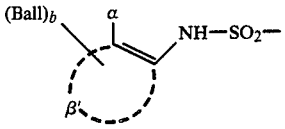

(CIII)

wherein Ball, $\alpha$ and b are the same as defined with (CII), $\beta'$ represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16130/81, 4043/82 and 650/82 and U.S. Pat. No. 4,053,312.

Further examples of Y suited for this type of compound are those represented by the following formula (CIV):

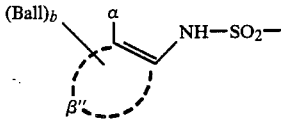

(CIV)

wherein Ball, $\alpha$ and b are the same as defined with the formula (CII), and $\beta''$ represents atoms necessary for foming a hetero ring such a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

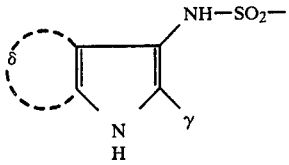

(CV)

wherein $\gamma$ preferably represents hydrogen, a substituted or unsubstituted alkyl, aryl or heterocyclic group, or $—CO—G^{21}$; $G^{21}$ represents $—OG^{22}$, $—SG^{22}$ or

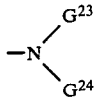

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a fused benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

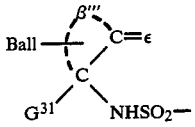

(CVI)

wherein Ball is the same as defined with the formula (CII); $\epsilon$ represents an oxygen atom or $=NG^{32}$ (wherein $G^{32}$ represents hydroxyl or an optionally substituted amino group) (examples of $H_2N—G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific example of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

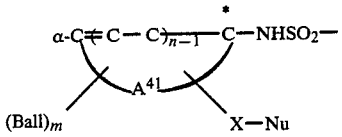

(CVII)

wherein $\alpha$ represents $OR^{41}$ or $NHR^{42}$; $R^{41}$ represents hydrogen or hydrolyzable component; $R^{42}$ represents hydrogen, or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- or 12-membered ring; Nu represents a nucleophilic group; n represents an integer of 1 or 2; and $\alpha$ may be the same as defined with the above described formula (CII). Specific examples of this type of Y are described in Japanese Patent Application (OPI) No. 20735/82.

As still further type of examples represented by the formula (CI), there are dye providing nondiffusible substances which release a diffusible dye in the presence of a base as a result of self cyclization or the like but which, when reacted with an oxidation product of a developing agent, substantially never release the dye.

Examples of Y effective for this type of compound are those which are represented by the formula (CVIII):

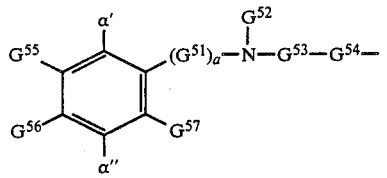

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

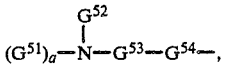

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

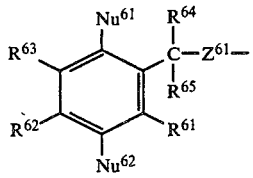

(CIX)

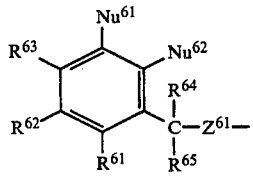

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by the formula (CXI):

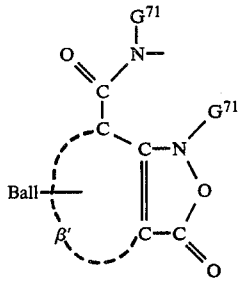

(CXI)

wherein Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

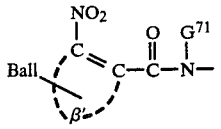

(CXII)

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

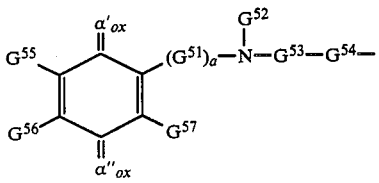

(CXIII)

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$ $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIV-A) and (CXIV-B):

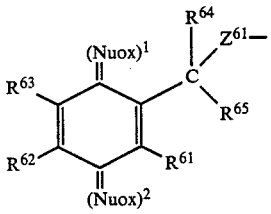

(CXIV-A)

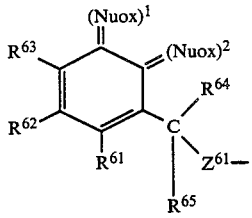

(CXIV-B)

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIV-A) and (CXIV-B) describe electron donors to be used in combination.

As still further different type of compound represented by the general formula (CI), there are illustrated LDA compounds (Linked Donor Acceptor Compounds). These compounds are dye providing non-diffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula (CXV) (specific examples thereof being described in Japanese Patent Application (OPI) No. 60289/83):

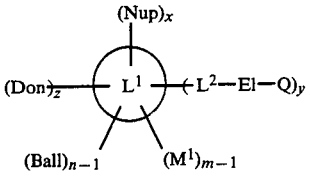

(CXV)

wherein n, x, y and z each represents 1 or 2, m represents an integer of 1 or more; Don represents a group containing an electron donor or its precursor moiety; $L^1$ represents an organic group linking Nup to $—L^2—El—Q$ or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance non-diffusible, and is preferably a group containing a $C_{8-32}$ hydrophobic group. Such organic ballast group is bound to the dye providing substance directly or through a linking group (e.g., an imino bond, an ether bond, a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

The dye providing substance used in the present invention can be introduced into a layer of the light-sensitive material by known methods such as the method as described in U.S. Pat. No. 2,322,027. In this case, an organic solvent having a high boiling point or an organic solvent having a low boiling point as described below can be used. For example, the dye providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used.

In the present invention, if necessary, a reducing agent may be used. The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the lightsensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch,, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above described bases or base precursors can be used not only for the acceleration of dye release but also for other purposes such as the control of a pH value.

The above described various ingredients to constituted a heat developable light-sensitive material can be arranged in arbitrary positions, if desired. For instance, one or more of the ingredients can be incorporated in one or more of the constituent layers of a light-sensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage to some cases.

The heat developable light-sensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes, etc.

In the present invention, after the heat developable color photographic material is exposed to light, the resulting latent image can be developed by heating the whole material to a suitably elevated temperatures. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, stytyl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Repesentative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themsevles do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehye condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc), active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants and so on, are those described in U.S. Pat. Nos. 4,500,626, 4,478,927, 4,463,079, and Japanese Patent Application Nos. 28928/83 (corresponding to U.S. Patent Application Ser. No. 582,655, filed on Feb. 23, 1984) and U.S. Pat. No. 4,503,137. Methods for the exposure and so on cited in the above described patents can be employed in the present invention also.

While the heat-developable light-sensitive material has a very good storage stability because of using a development-accelelating agent which is not basic and is stable at room temperature, it can provide an image having a good quality and a high S/N ratio by developing in a short period of time because of able to accelerate development by heating.

The present invention is described in detail by examples below, but the present invention is not limited thereto.

EXAMPLE 1

Preparation of Silver Iodobromide Emulsion 40 g of gelatin and 26 g of KBr were dissolved in 3,000 ml of water, and the resulting solution was stirred while maintaining it at 50° C. A solution of 34 g of silver nitrate dissolved in 200 ml of water was added to the above solution over a 10 minute period. Then, a solution of 3.3 g of KI dissolved in 100 ml of water was added to the solution for 2 minutes. The thus prepared silver iodobromide emulsion was adjusted in pH, precipitated, and freed of excess salts. It was then adjusted to pH 6.0, whereby 400 g of a silver iodobromide emulsion was obtained. Preparation of a gelain dispersion of Dye providing substance:

10 g of dye providing substance having the formula

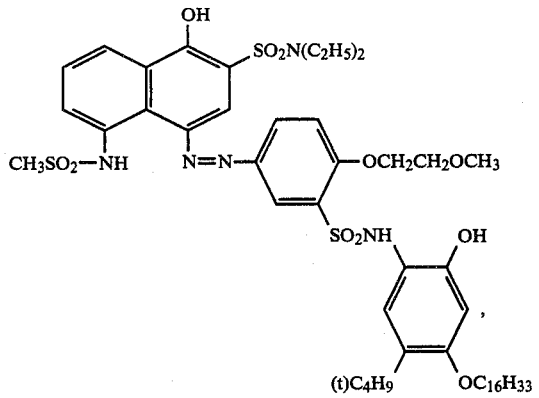

0.5 g of succinic acid 2-ethylhexyl ester sulfonic acid sodium salt as a surface active agent, and 20 g of tricresyl phosphate (TCP) were weighed out, and 30 ml of ethyl acetate was added thereto. They were then dissolved in the ethyl acetate by heating at about 60° C. The resulting solution was added to 100 g of a 10 wt% solution of gelatin, stirred, and dispersed for 10 minutes by means of a homogenizer at 10,000 rpm. The thus formed dispersion is hereafter referred to as the "dispersion of the dye providing substance".

Preparation of Light-Sensitive Coating

| | | |
|---|---|---|
| (a) | Light-sensitive silver iodobromide | 25 g |
| (b) | Dispersion of the dye providing substance | 33 g |
| (c) | 5% Aqueous solution of compound having the following formula | |

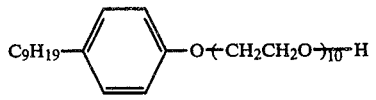

| | | |
|---|---|---|
| (d) | Solution of 1.5 g of trichloroacetyl guanidine dissolved in 15 ml of ethanol | |
| (e) | Solution of 0.4 g of $(CH_3)_2NSO_2NH_2$ dissolved in 4 ml of methanol | |
| (f) | Solution of 0.2 g of Compound (2) described as an example in this specification dissolved in | |

-continued

| |
|---|
| ml of methanol |

The above components (a) to (f) were mixed and dissolved by heating. The resulting solution was then coated on a 180 μm thick polyethylene terephthalate film in a wet thickness of 30 μm and dried. On the thus formed layer was further coated the following composition in a wet thickness of 25 μm to thereby form a protective layer.

Composition of Protective Layer

| | |
|---|---|
| 10 wt % Aqueous solution of gelatin | 30 g |
| Water | 70 ml |

The above prepared light-sensitive material was dried and exposed imagewise for 10 seconds by the use of a tungsten lamp at 2,000 lux. The material was then uniformly heated for 20 seconds on a heat block maintained at 140° C. The resultant material is hereafter referred to as Sample A.

Another light-sensitive material, Sample B, was prepared in the same manner as above, except that as the ingredient (f), only 4 ml of methanol (not containing compound (2)) was used. This material was processed in the same manner as above.

Preparation of Dye Fixing Material with Dye Fixing Layer 10 g of a methyl acrylate/N,N,N-trimethyl-N-vinylbenzylammonium chloride (1/1) copolymer was dissolved in 200 ml of water and then uniformly mixed with 100 g of 10% lime-processed gelatin. The resulting mixture was uniformly coated in a wet thickness of 90 μm on a paper support laminated with polyethylene. The thus prepared material was dried and used as a dye fixing material.

The dye fixing material was dipped in water, and then removed from the water. The above heated light-sensitive materials, Samples A and B, were superposed on separate pieces of the dye fixing material in such a manner that the coatings came into contact with each other. They were then heated for 6 seconds on a heat block maintained at 80° C. Then, the dye fixing material was separated from the light-sensitive material, whereupon a negative magenta dye image was formed on the dye fixing material. The density of the negative image was measured with a Macbeth transmission densitometer (TD-504). The results are shown in Table 1 below.

TABLE 1

| Sample | Maximum Density | Minimum Density |
|---|---|---|
| A (Example of the Invention) | 2.12 | 0.20 |
| B (Comparative Example) | 1.03 | 0.18 |

It can be seen from the results of Table 1 that if the compound of the present invention is used, the maximum density can be greatly increased without a substantial increase in the minimum density, as compared with the comparative example containing no compound of the present invention.

EXAMPLE 2

The procedure of Example 1 was repeated wherein the compounds as indicated in Table 2 were used in place of Compound (2). The results are shown in Table 2.

TABLE 2

| Sample No. | Compound Used | Amount | Dmax. | Dmin. |
|---|---|---|---|---|
| C | Compound (4) | 0.23 g | 2.10 | 0.18 |
| D | Compound (8) | 0.25 g | 2.23 | 0.26 |
| E | Compound (14) | 0.35 g | 2.16 | 0.20 |
| F | Compound (16) | 0.32 g | 2.18 | 0.18 |

It is further seen from the results of Table 2 that if the compounds of the present invention are used, the maximum density can be greatly increased without a substantial increase in the minimum density.

EXAMPLE 5

Dye providing substance dispersion α and β were prepared in the same manner as in Example 1, except that in place of the dye providing substance of Example 1, substances having the following formulae were used in an amount of 10 g each.

Dye providing substance dispersion α

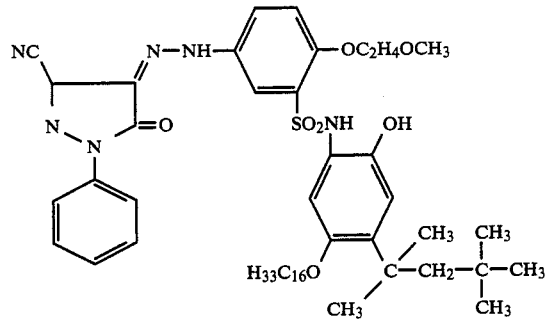

Dye providing substance dispersion β

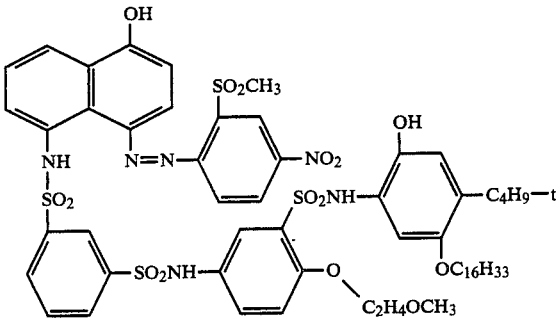

Thereafter, the same procedure as in Example 1 was repeated. The results are shown in Table 3.

TABLE 3

| Used Dye Providing Substance Dispersion | Compound of the present invention | Maximum Density | Minimum Density |
|---|---|---|---|
| Dispersion α | (2) | 1.40 | 0.12 |
| Dispersion α | — | 0.65 | 0.11 |
| Dispersion β | (2) | 2.28 | 0.21 |
| Dispersion β | — | 1.15 | 0.20 |

It can be seen from the results of the Table 3 that the compound of the present invention provide a very high maximum density.

EXAMPLE 4

The emulsion prepared in such a way as below was used in place of the emulsion of Example 1.

6.5 g of benzotriazole and 10 g of gelatin were dissolved in 1,000 ml of water and the resulting solution was stirred while maintaining it at 50° C. A solution of 8.5 g of silver nitrate dissolved in 100 ml of water was added to the above solution for 2 minutes.

A solution of 1.2 g of potassium bromide dissolved in 50 ml of water was added to the above solution for 2 minutes. The thus formed emulsion was adjusted in pH, precipitated, and freed of excess salts. Then, the emulsion was adjusted to a pH of 6.0 (yield 200 g).

Preparation of Light-Sensitive Coating (a) Benzotriazole silver emulsion containing light-sensitive silver bromide — 10 g (b) Dye providing substance dispersion (same as used in Example 1) — 3.5 g (c) Solution of 0.35 g of a compound having the formula shown below in 3 ml of a water/ethanol (50/50 by volume) mixture

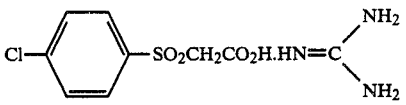

(d) 5 wt% Aqueous solution of a compound having the following formula — 1.5 ml

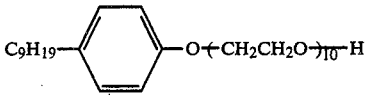

(e) Solution of 0.3 g of $(CH_3)_2NSO_2NH_2$ dissolved in 4 ml of ethanol (f) Solution of 0.25 g of Compound (2) of the present invention dissolved in 4 ml of ethanol The above ingredients (a) to (f) were mixed. Thereafter the same procedure as in Example 1 was repeated. The results are shown in Table 4 below.

TABLE 4

| Sample | Maximum Density | Minimum Density |
|---|---|---|
| Comparative Compound (2) (Example of the Invention) | 2.10 | 0.20 |
| Not containing Compound (2) (Comparative Example) | 1.10 | 0.18 |

It can be seen from the results of Table 4 that if the compound of the present invention is used, a high maximum density can be obtained.

EXAMPLE 5

The same emulsion as in Example 4 was prepared.

A dye providing substance dispersion was prepared in the same manner as in Example 1, wherein 10 g of a substance having the following formula was used.

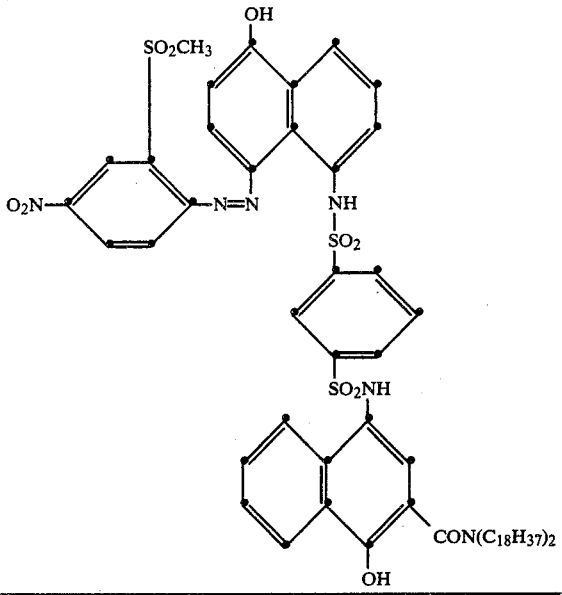

(a) Benzotriazole silver emulsion containing light-sensitive silver bromide (same as used in Example 4) — 10 g (b) Dye providing substance dispersion — 3.5 g (c) Solution of 0.35 g of Compound (12) dissolved in 4 ml of ethanol (d) Solution of 0.2 g of a compound having the formula as shown below in 4 ml of water

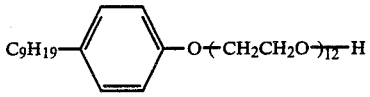

(e) Solution of 0.3 g of $(CH_3)_2NSO_2NH_2$ dissolved in 4 ml of ethanol

The above ingredients (a) to (e) were mixed and then dissolved by heating. The resulting solution was coated on a 180 μm thick polyethylene terephthalate film in a wet thickness of 30 μm. The thus produced light-sensitive material was dried and then exposed imagewise by the use of a tungsten lamp at 2,000 lux for 10 seconds. The material was then uniformly heated for 30 seconds on a heat block maintained at 160° C. This material was designated as Sample A.

Another light-sensitive material, Sample B, was prepared in the same manner as above, except that as the ingredient (c), only 4 ml of ethanol was used; Compound (8) was not added. This material was processed in the same manner as above.

A dye fixing material was prepared in the same manner as in Example 1. Thereafter, the same procedure as in Example 1 was repeated. The results are shown in Table 5 below.

TABLE 5

| Sample | Maximum Density | Minimum Density |
|---|---|---|
| A (Example of the Invention) | 1.63 | 0.29 |
| B (Comparative Example) | 0.85 | 0.22 |

It can be seen from the results of Table 5 that if the compound of the present invention is used, the maximum density is greatly increased compared with a case in which it is not used, with only an insubstantial increase in the minimum density.

While the invention has been described in detail and with reference to specific embodiments thereof, it will be apparent to one skilled in the art that various changes and modifications can be made therein without departing from the spirit and scope thereof.

What is claimed is:

1. A heat-developable silver-halide photographic light-sensitive material comprising a support having thereon, at least one layer containing a compound represented by formula (I) or (II)

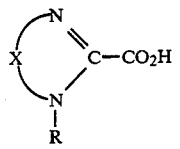

(I)

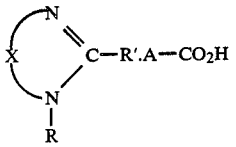

(II)

wherein R and R′ each represents a group selected from a hydrogen atom, an alkyl group, a cycloalkyl group, an alkenyl group, an alkynyl group, an aralkyl group, an aryl group, an amino group, an acylamino group, an alkoxy group, an alkylthio group, a sulfonylamino group, a heterocyclic ring group and a substituted group of them; X represents atoms forming a 5-membered or 6-membered ring; and A represents a group causing a decarboxylation reaction.

2. A heat-developable silver-halide photographic light-sensitive material as in claim 1, wherein R and R′ each represents a group selected from a hydrogen atom, a substituted or unsubstituted alkyl group having from 1 to 8 carbon atoms, a substituted or unsubstituted aralkyl group having from 7 to 14 carbon atoms, a substituted or unsubstituted amino group, an alkylthio group having from 1 to 4 carbon atoms, and an alkoxy group having from 1 to 4 carbon atoms.

3. A heat-developable silver-halide photographic light-sensitive material as in claim 1, werein R and R′ each represents a group selected from a hydrogen atom, a substituted or unsubstituted lower alkyl group having from 1 to 3 carbon atoms, a substituted or unsubstituted amino group, a substituted or unsubstituted alkoxy group having from 1 to 3 carbon atoms, and a substituted or unsubstituted alkylthio group having from 1 to 3 carbon atoms.

4. A heat-developable silver halide photographic light-sensitive material as in claim 1, wherein X represents atoms necessary for forming an imidazole ring, a benzimidazole ring, an imidazoline ring or a tetrahydropyrimidine ring.

5. A heat-developable silver-halide photographic light-sensitive material as in claim 1, wherein said compound represented by formula (I) or (II) is incorporated in said layer in an amount of not more than 50% by weight, based on the total weight of the layer in which it is incorporated.

6. A heat-developable silver-halide photographic light-sensitive material as in claim 2, wherein said compound represented by formula (I) or (II) is incorporated in said layer in an amount of not more than 50% by weight, based on the total weight of the layer in which it is incorporated.

7. A heat-developable silver-halide photographic light-sensitive material as in claim 3, wherein said compound represented by formula (I) or (II) is incorporated in said layer in an amount of not more than 50% by weight, based on the total weight of the layer in which it is incorporated.

8. A heat-developable silver-halide photographic light-sensitive material as in claim 4, wherein said compound represented by formula (I) or (II) is incorporated in said layer in an amount of not more than 50% by weight, based on the total weight of the layer in which it is incorporated.

9. A heat-developable silver-halide photographic light-sensitive material as in claim 1, wherein said compound represented by formula (I) or (II) is incorporated in said layer in an amount of from 0.01% to 40% by weight, based on the total weight of the layer in which it is incorporated.

10. A heat-developable silver-halide photographic light-sensitive material as in claim 2, wherein said compound represented by formula (I) or (II) is incorporated in said layer in an amount of from 0.01% to 40% by weight, based on the total weight of the layer in which it is incorporated.

11. A heat-developable silver-halide photographic light-sensitive material as in claim 3, wherein said compound represented by formula (I) or (II) is incorporated in said layer in an amount of from 0.01% to 40% by weight, based on the total weight of the layer in which it is incorporated.

12. A heat-developable silver-halide photographic light-sensitive material as in claim 4, wherein said compound represented by formula (I) or (II) is incorporated in said layer in an amount of from 0.01% to 40% by weight, based on the total weight of the layer in which it is incorporated.

13. A heat-developable silver halide photographic light-sensitive material as in claim 1, wherein a silver halide light sensitive emulsion is coated on the support.

* * * * *